US005411177A

United States Patent [19]

Blake, III

[11] Patent Number: 5,411,177

[45] Date of Patent: May 2, 1995

[54] FOAM DISPENSING APPARATUS

[75] Inventor: Joseph W. Blake, III, New Canaan, Conn.

[73] Assignee: Jack W. Kaufman, Merrick, N.Y.

[21] Appl. No.: 84,422

[22] Filed: Jun. 20, 1993

Related U.S. Application Data

[63] Continuation-in-part of Ser. No. 763,366, Sep. 20, 1991, Pat. No. 5,222,633.

[51] Int. Cl.[6] ..... B67D 5/00

[52] U.S. Cl. ..... 222/105; 222/190; 222/400.7; 222/564; 239/343; 239/370

[58] Field of Search ..... 222/190, 400.7, 400.8, 222/564, 105; 239/337, 343, 346, 370

[56] References Cited

U.S. PATENT DOCUMENTS

| | | | |
|---|---|---|---|
| Re. 33,564 | 4/1991 | Ford, Jr. | 222/209 |
| 1,919,257 | 7/1933 | Renzenhausen | 222/179 X |
| 2,153,156 | 4/1939 | Pollnow | 222/179 X |
| 4,531,660 | 7/1985 | Ford, Jr. | 222/209 |
| 5,085,371 | 2/1992 | Paige | 239/343 |
| 5,222,633 | 6/1993 | Blake | 222/179 |
| 5,238,155 | 8/1993 | Blake, III | 222/190 |
| 5,269,444 | 2/1993 | Wright | 222/190 |

FOREIGN PATENT DOCUMENTS

| | | |
|---|---|---|
| 1389615 | 4/1972 | United Kingdom . |
| 2031724 | 8/1979 | United Kingdom . |

*Primary Examiner*—Andres Kashnikow
*Assistant Examiner*—Anthoula Pomrening
*Attorney, Agent, or Firm*—Lackenbach Siegel Marzullo Aronson and Greenspan

[57] ABSTRACT

A foam dispensing apparatus which includes a foamable liquid container and a foam generating device for mixing a gas with a foamable liquid. The foam generating device has a plurality of passages through which pressurized gas flows simultaneously with foamable liquid into the foam generating chamber past a flow restrictor. The passages are formed by a plurality of vertical flutes or horizontal grooves in one of the members.

31 Claims, 10 Drawing Sheets

FOAM DISPENSING APPARATUS

CROSS REFERENCE TO RELATED APPLICATIONS

This application is a continuation-in-part of U.S. Ser. No. 07/763,366, filed on Sep. 20, 1991, now U.S. Pat. No. 5,222,633, granted Jun. 29, 1993.

BACKGROUND OF THE INVENTION

1. Field of the Invention

This invention relates to devices for producing and dispensing foams made by mixing foamable liquids and pressurized gases. More particularly, this invention is directed to a device for dispensing a foam such as a soap fluid which can be manually or automatically actuated without requiring the squeezing or deformation of a foam containing vessel and which can be disposable in whole or part.

2. Description of the Related Art

Hand operated dispensing bottles such as are disclosed in U.S. Pat. No. 3,323,689 are used for dispensing liquid soaps cleaning fluids, and the like. Handheld squeeze bottles of relatively small capacity for generating foams by non-aerosol techniques are widely known, for example, as described in U.S. Pat. Nos. 3,709,437, 3,937,364 and 4,531,660. Squeeze bottles, while effective for many purposes are necessarily of limited capacity and do not permit the hands of the user to be uninvolved in the use of the device. U.S. Pat. No. 4,957,218 discloses a manually operated foaming device and dispenser which uses manually generated positive pressure to generate foam and negative pressure to refill an auxiliary pump reservoir. Other foam generating devices are described in my prior patents, U.S. Pat. Nos. 4,901,925 and 4,991,779.

SUMMARY OF THE INVENTION

It is an object of the present invention to provide a self cleaning foam generating apparatus.

It is another object of this invention to provide a foam dispensing apparatus which can be readily disposable in whole or in part.

It is a further object of the invention to provide a foam dispensing apparatus which is especially useful for "wash-ups" by medical personnel.

Another object of this invention is to provide a foaming device in which foaming fluids do not pass through a porous element as many solutions such as PVP, and CHG, are prone to congeal and clog the porous element.

Another object is to provide a foaming device that is simple and inexpensive enough to allow for cost-effective disposability.

Another object of the invention is to provide a foam generating apparatus which utilizes collapsible foamable liquid containers.

Another object of the invention is to provide a foam generating apparatus which uses a collapsible, disposable and refillable container for the foamable liquid.

Another object of the invention is to provide a foam generating apparatus which utilizes a pressurized gas in a collapsible container without requiring a rigid retaining sleeve.

It is a still further object of the invention to provide a foam generating apparatus which has an internal pressure retaining chamber for producing incremental portions of foam.

The foam generating apparatus in accordance with the present invention includes a container, a self cleaning foaming device having a receiving portion, a foam generating portion, and a discharge portion. The receiving portion holds one end of a draw tube and defines a plurality of elongated passages between the tube and the receiving portion for directing a pressurized gas, such as air, passing from the container along side the tube into the foam generating portion. The foam generating portion has a flow restrictor in a chamber for mixing foamable liquid, such as a foamable liquid soap, with the pressurized gas from the passages to produce foam. The discharge portion is a open ended pipe or other tubular body through which the foam is dispensed to the user. The present invention is particularly effective with difficult to foam liquids such as povidone iodine (PVP) and chlorhexidine gluconate (CHG) which are difficult to foam since the foaming agents normally added to conventional soap solutions are excluded.

A first preferred embodiment of the apparatus of the invention preferably comprises a rigid container, removably connected to a foam generating device, for containing a foamable liquid, a draw tube therein extending from a bottom tube opening in a bottom portion of the container through the top of the container into a receiving portion of the foam generating device. The receiving portion has a cylindrical chamber with axial flutes in its sidewall. The tube and the flutes in the receiving portion define a plurality of elongated passages parallel to the axis of the tube around the outside of the tube communicating between the upper portion of the container and a foam generating portion of the device. A gas inlet means is provided for directing a pressurized gas into the container, above the level of liquid therein, to force the foamable liquid up the draw tube and into the foam generating portion.

Pressurized gas simultaneously passes through the elongated passages past the end of the draw tube and directly into the foam generating portion where it mixes with the liquid flowing around the flow restrictor to form the foam. In this embodiment, the flow restrictor is a solid body having opposing generally conical ends.

A second preferred embodiment of the apparatus is similar to the first except that a pressurizable chamber, as is described in my prior U.S. Patent No. 4,901,925, encloses the lower end of the tube and the connection to the pressurized gas supply. This chamber has a check valve in the bottom which permits liquid to flow from the container into the chamber only when the chamber is unpressurized. This embodiment dispenses an increment of foam whose size is determined by the volume of liquid in the chamber prior to each pressurization.

A first alternative embodiment of the apparatus of the invention is similar to the first two described above except for the flow restrictor which is a pointed cylindrical post integrally attached to a part of the foam generating portion.

A second alternative embodiment has the plurality of passages between the tube and the receiving portion formed in an annular ledge against which the upper end of the draw tube abuts. A third alternative embodiment has the passages formed by flutes in the transverse end surface of the upper end of the draw tube and a flat annular ledge between the receiving portion and the foam generating portion. A fourth alternative has a flat ledge and a flat tube end. The elongated passages are formed in one surface of at least one fluted washer which is sandwiched between the upper end of the tube and the ledge between the receiving portion and the foam generating portion.

A third embodiment of the foam generating apparatus in accordance with the invention has a collapsible bag or pouch shaped container. This embodiment is similar to the first embodiment except that the draw tube fits into a connector which mates with both the receiving portion of the foam generating device and the pressurized gas connector. The collapsible bag is surrounded by a removable, generally rigid retainer which supports the bag during pressurization. This foam generating device in this embodiment may incorporate any of the alternative device embodiments described above.

A fourth preferred embodiment is similar to the third embodiment except that no retainer is required. An internal generally rigid chamber surrounds the lower end of the draw tube and the pressurized gas connector. This chamber has a check valve in the bottom and operates as described above with reference to the second preferred embodiment.

These and other features, objects and advantages of the invention will become more apparent from a reading of the following detailed description when taken in conjunction with the various figures of the accompanying drawing.

DETAILED DESCRIPTION OF THE PREFERRED EMBODIMENTS

First Preferred Embodiment

Figure 1:
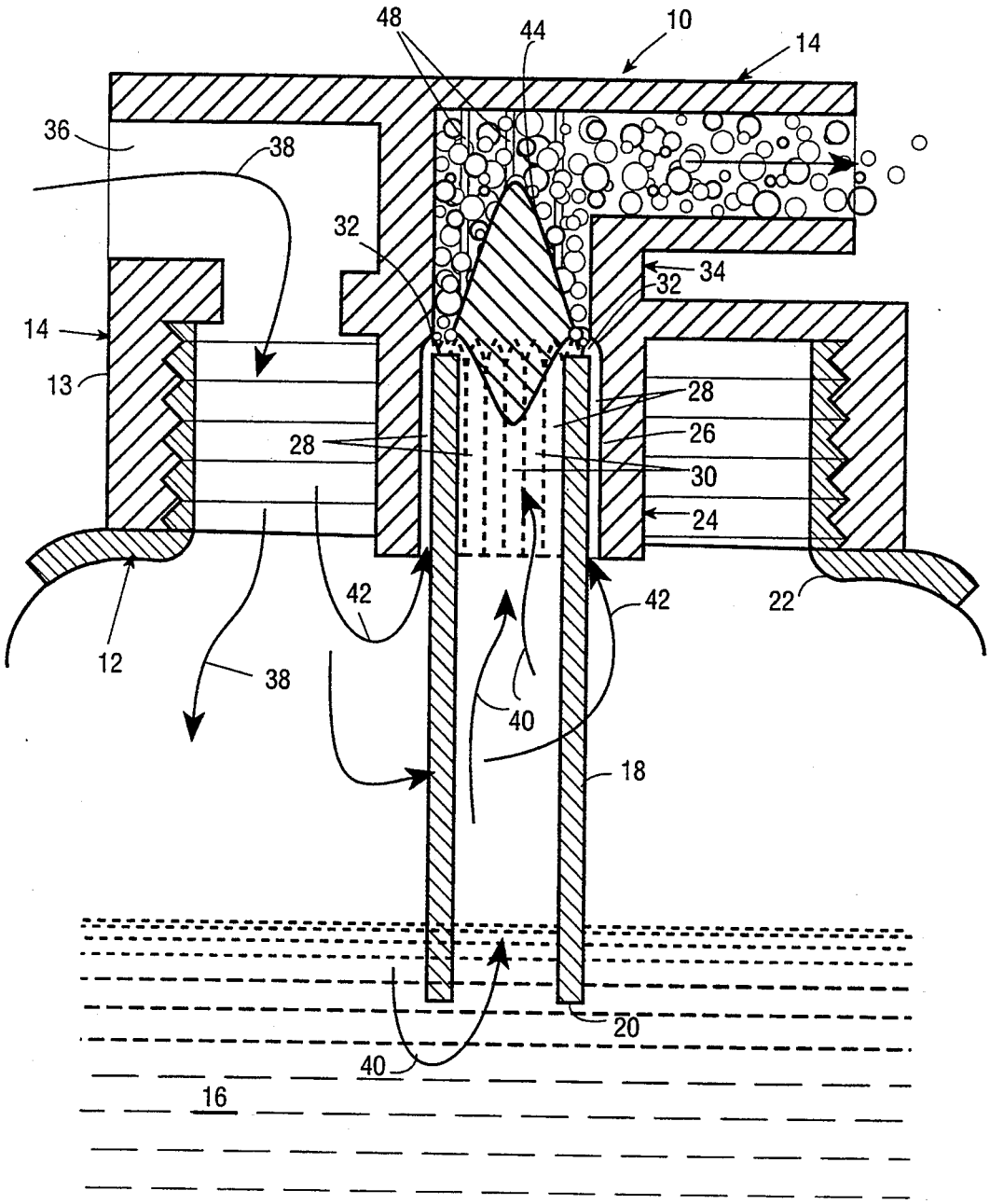
FIG. 1 is a schematic view in section of a first embodiment of a foam dispensing apparatus of the invention.

A first preferred embodiment of the foam generating apparatus in accordance with the invention is shown schematically in FIG. 1. The apparatus 10 comprises a rigid container 12, removably connected to a foam generating device 14. The container 12 may have a threaded cap connection as shown in FIG. 1, a bayonet or snap together type connection or any other suitable means of joining the container to the foam generating device 14. The container 12 is preferably made of plastic, glass or metal but may also be made of any other self supporting material. The container 12 is designed to hold a quantity of foamable liquid 16. The foamable liquid 16 can be any foamable liquid but most advantageously, the present invention may be optimized for such liquid cleaning agents as PVP or CHG. One suitable foamable liquid is "Bioscrub" by BioMed Packaging, Inc. This liquid is 4% CHG with 4% isopropanol in aqueous solution.

A draw tube 18 is disposed in the container 12, and extends from a bottom tube opening 20 in a bottom portion of the container 12 through the top 22 of the container 12 into a receiving portion 24 of the foam generating device 14. The receiving portion 24 has a cylindrical chamber having a sidewall 26 with axial flutes 28 in the sidewall 26. The tube 18 is sized such that the outer surface of the tube 18 preferably frictionally mates with the ridges between adjacent flutes 28. The flutes may preferably have a "V" or "U" shaped cross section and extend axially the full length of the receiving portion. The upper ends 32 of the flutes 28, adjacent the contiguous foam generating portion 34, are preferably tapered gradually to a preferred passage size.

The flutes 28 and the upper end of the tube 18 in the receiving portion define a plurality of elongated passages parallel to the axis of the tube 18 around the outside of the tube 18. These passages communicate between the upper portion of the container 12 and the foam generating portion 34 of the device 14.

A gas inlet means 36 is provided for directing a pressurized gas, usually air, into the container 12, as shown by the arrows 38 above the level of liquid 16 to force the foamable liquid 16 up the draw tube, as is shown by arrows 40, into the foam generating portion 34.

The pressurized gas simultaneously passes, as shown by arrows 42, through the elongated passages formed by flutes 28 past the upper end of the draw tube 18 and directly into the foam generating portion 34. Here the gas enters the liquid as fine bubbles and mixes with the liquid flowing around a flow restrictor 44 to form the foam.

The foam generating portion 34 is a hollow chamber 46 which is coaxially contiguous with the receiving portion 24. The foam generating portion 34 in turn connects to the discharge portion 48 which is usually a spigot type tubular member preferably integrally connected with the foam generating portion 34.

In this embodiment, the flow restrictor 44 is a solid body having opposing generally conical end portions. The waist of the flow restrictor, where the two conical portions merge, rests against the upper end of the draw tube 18 when the container 12 is unpressurized.

The lower ends of a plurality of circumferentially spaced axial ribs 48 in the hollow chamber 46 are used to confine upward movement of the flow restrictor 44 by engaging with the waist of the flow restrictor 44 when the container 12 is pressurized and liquid 16 pushes up through the tube 18 and past the waist of the flow restrictor 44. The spacing is such that an adequate amount of foamable liquid 16 passes in conjunction with the air flow through the fluted passages past the flow restrictor.

In this embodiment where the flow restrictor 44 is not integrally formed with the foam generating device 14 (as will be described hereinafter with respect to the integral flow restrictor shown in FIGS. 3 and 4), the flow restrictor 44 is held snugly in place by the axial ribs 48 and by the top of the draw tube 18 so as aid in fixedly maintaining the flow restrictor 44 in position.

Each of the flow passages formed by the flutes 28, at the upper ends 32, should have a cross sectional area equivalent to a hole diameter of between about 0.002 and 0.012 inches. Other optimum sizes may be more appropriate for other foamable liquids of other viscosities and other flow characteristics.

Second Preferred Embodiment

Figure 2:
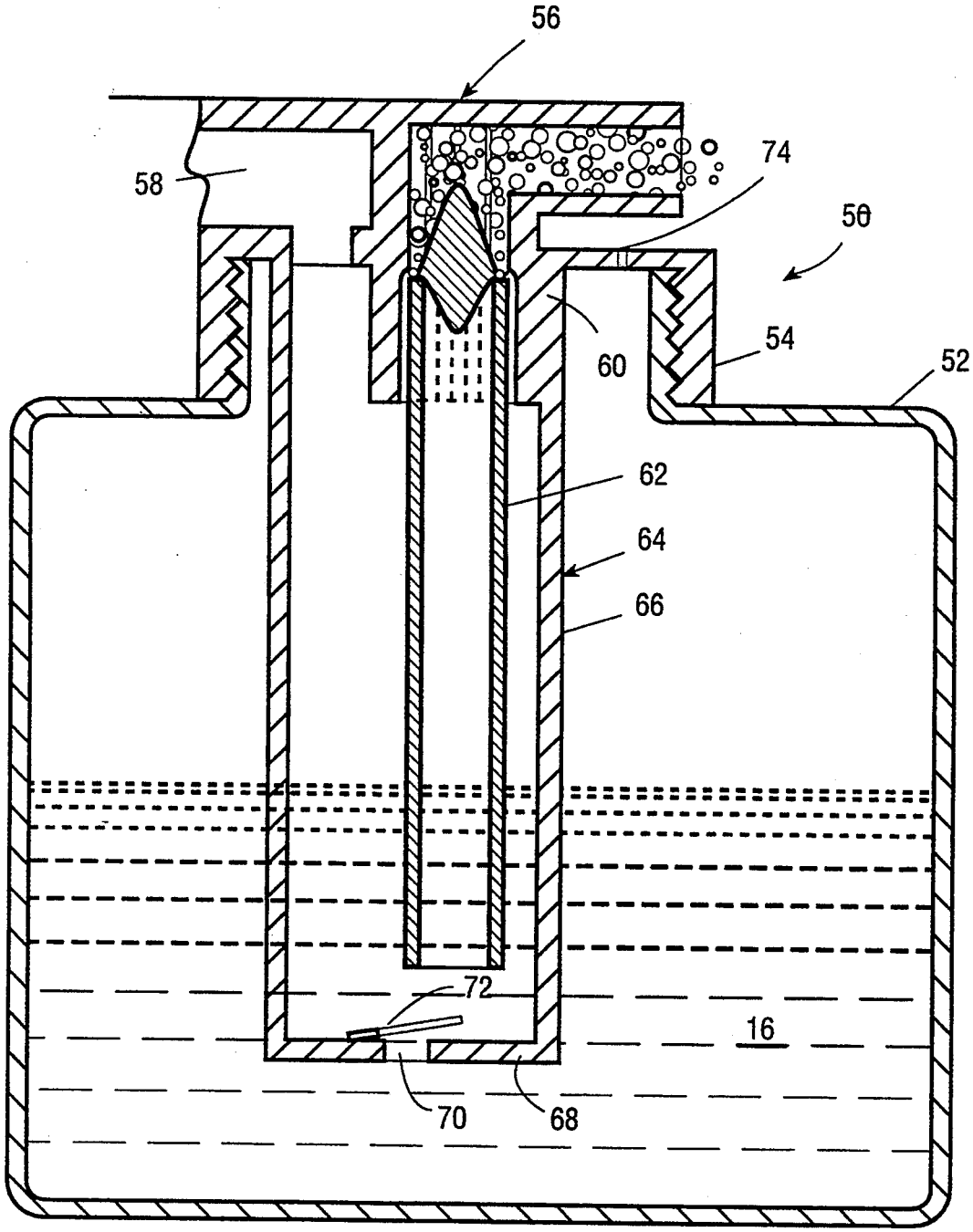
FIG. 2 is an elevation view in section of a second embodiment of a foam dispensing apparatus in accordance with the invention.

A second preferred embodiment 50 in accordance with the invention is illustrated in section in FIG. 2. The foam dispensing apparatus 50 comprises a container 52 which has a threaded cap connection 54 to a foam generating device 56 as in the first preferred embodiment above described. The cap connection 54 includes a pressurized gas port 58 adjacent the receiving portion 60 of the foam generating device 56 which permits gas entry into the container 52. A draw tube 62 has its upper end frictionally engaged in the receiving section 60 as in the first preferred embodiment and the lower end of the tube is positioned near the bottom of the container 52.

The principal difference between this embodiment and the first preferred embodiment, is a pressure chamber 64 which is integrally attached to the foam generating device 56 and which extends below the bottom of the tube 62. The pressure chamber 64 encloses both the draw tube 62 and the gas inlet port 58. The pressure chamber 64 has a rigid vertical tubular wall 66 and a bottom wall 68 beneath the lower end of the tube 62. The bottom 68 has an aperture 70 therethrough which is in turn closed by an interior flap or one-way check valve 72. This flap 72 only opens upward as is shown in FIG. 2 if the pressure inside the chamber 64 is less than the pressure at the aperture 70. This will occur when the level of liquid 16 is greater outside the chamber than inside the chamber and the chamber 64 is unpressurized.

A small equalizing valve or hole 74 through the top of the closure cap 54 permits atmospheric pressure to be applied to the level of liquid 16 in the container 52. The valve 74 may be a flap covering such a vale or hole as does flap 72 or simply a small hole may be suitable provided. Alternatively, small ball check valves may be used in place of the aperture 70 and flap 72 and the hole or valve 74.

This pressurization chamber arrangement permits only an incremental amount of foam to be generated each time the apparatus 50 is actuated by depression of a suitable pedal pump as best described in my copending parent patent application, now U.S. Pat. No. 5,222,633 issued Jun. 29, 1994. The pressurization chamber 64 must be depressurized and allowed to refill between foam generating operations. This can be advantageously used to limit the quantity of soap that a user receives thereby saving costs. Again, this embodiment is identical to the first preferred embodiment except for the presence of the pressurization chamber 64 and the equalization valve or hole 74 thus physically operates in the same way to produce foam. Also, the alternatives suggested above for the first preferred embodiment apply equally well here. A discussion of other alternative embodiments of the foam dispensing apparatus follow.

Alternative Embodiments

Figure 3:
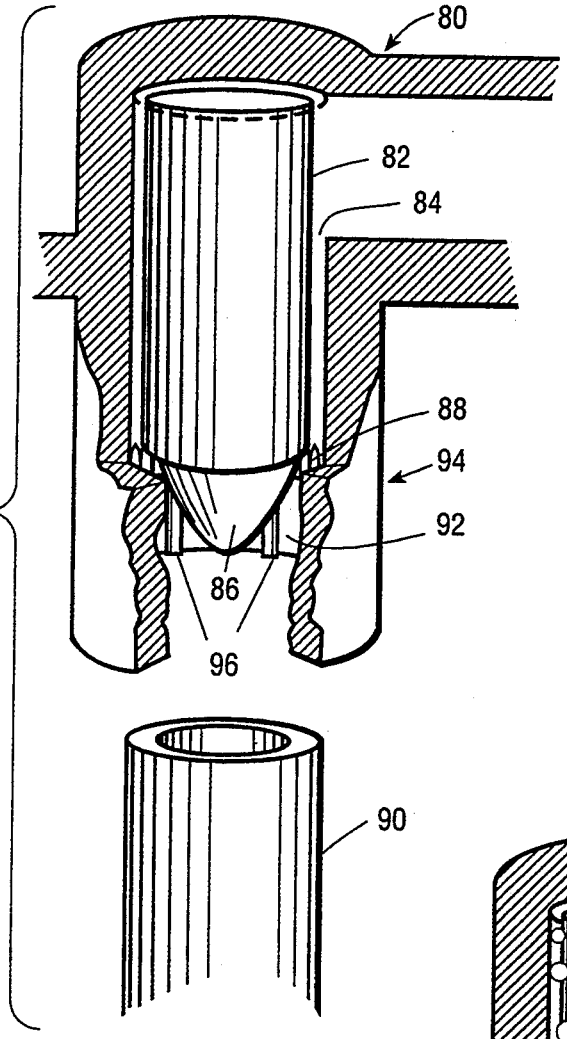
FIG. 3 is an enlarged, partial perspective exploded view of a first alternative embodiment of the foam generating device in either of the dispensing apparatus shown in FIGS. 1 or 2 in greater detail.
Figure 4:
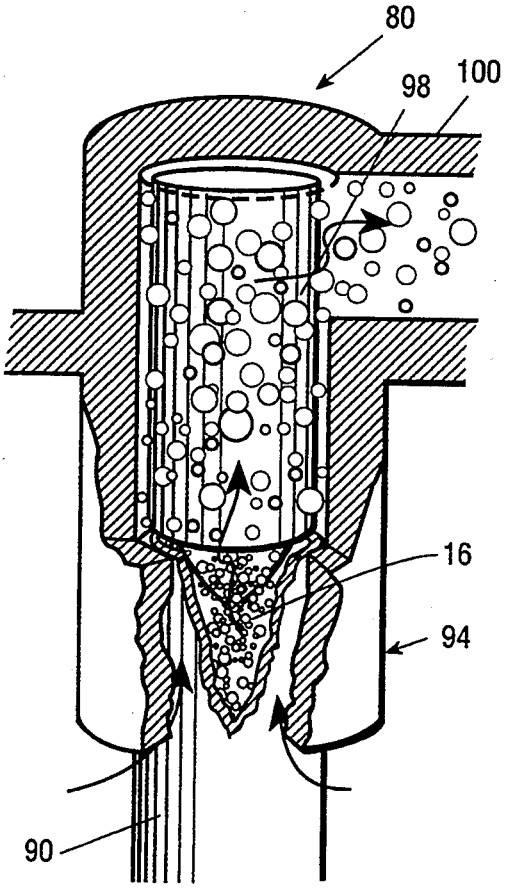
FIGS. 4 is an assembled view of the first alternative shown in FIG. 3 illustrating the direction of air and liquid flows.

A first alternative embodiment 80 of the foam generating device in the apparatus of the invention is shown in FIGS. 3 and 4. This alternative foam generating device 80 is similar to the devices 14 and 56 of the first two preferred embodiments described above except for the flow restrictor 82 and the foam generating chamber 84. In this alternative, the foam generating chamber 84 is a cylindrical cavity coaxial with the receiving portion 86. The flow restrictor 82 is a solid cylindrical post centrally disposed in the chamber 84. The base of the flow restrictor 82 is preferably integrally fixed to the wall of the chamber 84 so that it is stationary. Thus ribs are not needed to locate the flow restrictor as in the first two preferred embodiments discussed above. The flow restrictor 82 has a pointed nose which extends into the end of the tube 90.

Another difference between this first alternative and the device in the first two preferred embodiments is the length of the flutes 88. Here the flutes 88 are short, only covering the end of the tube 90. The tube 90 is spaced from the inner wall 92 of the receiving portion by circumferentially spaced ribs 96. However, the combination of the ribs and short flutes 88 and the tube 90 still define effectively a plurality of elongated passages between the receiving portion and the foam generating portion of the device 80.

As shown in FIG. 4, upon gas pressurization, the gas pressurization forces the liquid 16 to rise in the tube 90 and meet simultaneously with gas bubbles at the flow restrictor 82 and flow around the post of the flow restrictor in the direction of the arrows 98 to the discharge portion 100.

Figure 5:
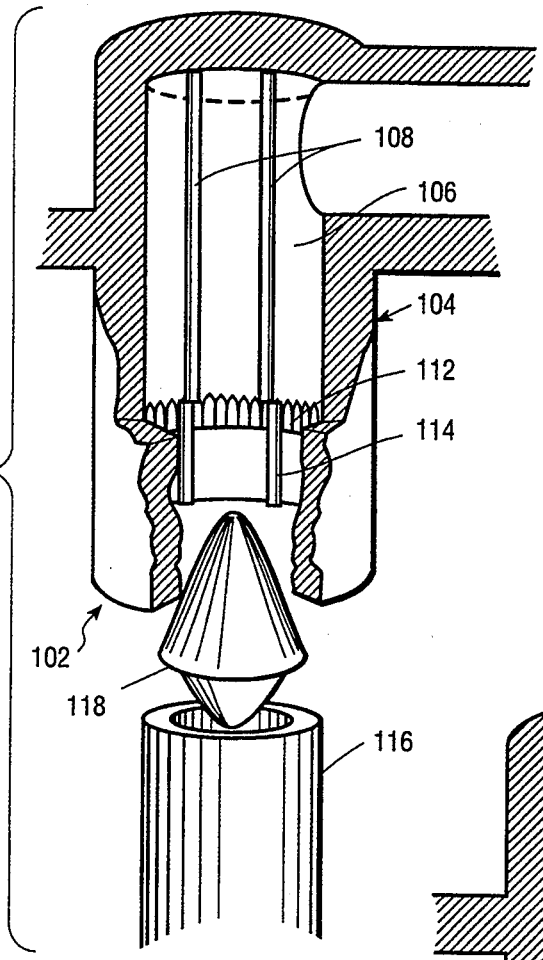
FIG. 5 is an exploded partial perspective exploded view of a second alternative embodiment of the foam generating device in the dispensing apparatus shown in either FIGS. 1 or 2.
Figure 6:
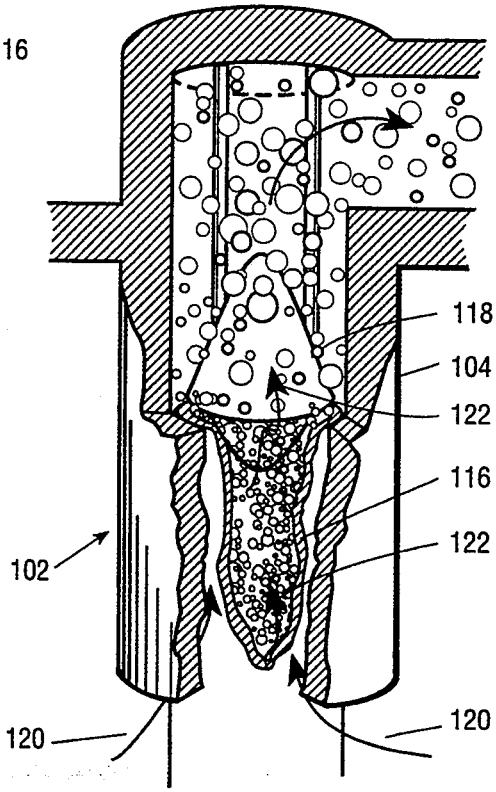
FIG. 6 is an assembled view of the second alternative embodiment shown in FIG. 5 illustrating the direction of liquid and gas flows.

A second alternative embodiment 102 of the foam generating device of the invention is similar to the first preferred embodiment 14 except that it has short flutes and long ribs in the receiving section as just described. Specifically referring to FIG. 5, the foam generating portion 104 of the device 102 has a cylindrical chamber 106 which has circumferentially spaced ribs 108 which extend axially to the margin of the receiving portion 110. There, the ribs 108 meet a plurality of short flutes 112 around the perimeter of the chamber 106. The receiving portion has a plurality of spaced axial ribs 114 sized to frictionally hold the upper end of the draw tube 116. A double conical flow restrictor 118 is sandwiched between the end of the tube 116 and the ribs 108 in the foam generating portion 104. The plurality of flutes and the comer of the tube end forms the critical passage openings between the receiving portion and the foam generating portion and preferably have comparable cross sectional areas. FIG. 6 again shows the flow path of gas via arrows 120 and the liquid via arrows 122.

Figure 7:
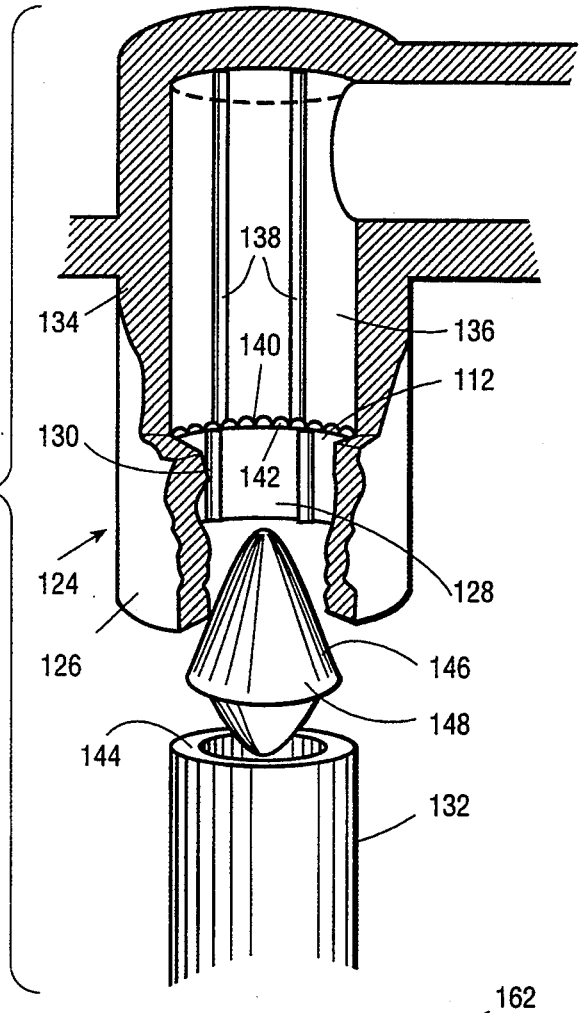
FIG. 7 is an enlarged, partial perspective exploded view of a third alternative embodiment of the foam generating device in the dispensing apparatus shown in either of FIGS. 1 or 2 in greater detail.

A third alternative embodiment of the foam generating device 124 is shown in FIG. 7. Here the receiving portion 126 has a cylindrical inner wall 128 and a plurality of circumferentially spaced axially extending ribs 130 which frictionally engage the outside of the upper end of the draw tube 132. The foam generating portion 134 has a cylindrical chamber 136 which also has a plurality of circumferentially spaced axially extending ribs 138. The chamber 136 has a smaller diameter than the receiving portion 126 so that an annular ledge 142 is formed at the merger of the portions. This ledge 140 has a plurality of radial flutes 142 which together with the smooth flat end surface 144 of the draw tube 132 define elongated passages between the receiving portion 126 and the foam generating portion 134. As in the first preferred embodiment 14, this embodiment has a removable double cone shaped flow restrictor 146 captured between the tube 132 and the foam generating portion 134. The flow restrictor has a smooth generally circular waist 148 which engages the end 144 of the tube 132 to limit downward movement of the flow restrictor 146 and engages the ends of the ribs 138 to limit upward movement of the flow restrictor 146.

Figure 8:
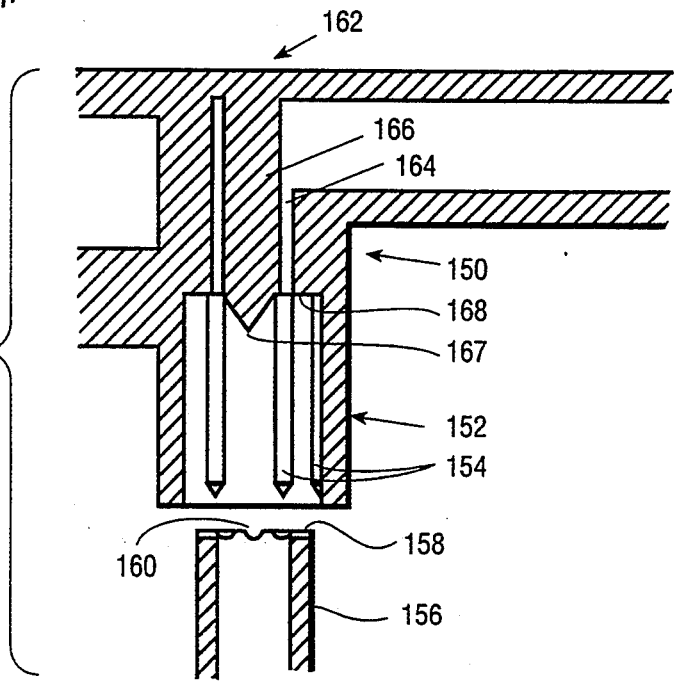
FIG. 8 is a partial elevational exploded sectional view of a fourth embodiment of the foam generating device in the dispensing apparatus shown in either FIGS. 1 or 2 in accordance with the invention wherein the tube has a fluted end.

A fourth alternative embodiment 150 of the foam generating device of the invention is shown in exploded cross section in FIG. 8. The receiving portion 152 has a plurality of circumferentially spaced axial ribs 154 which frictionally engage the outer surface of a draw tube 156 to space it from the inner wall of the receiving portion 152 of the foam generating device 150. The annular upper end surface 158 of the draw tube 156 is orthogonal to the axis of the tube 156 and has a plurality of radial flutes 160 directed toward the axis of the tube. The foam generating portion 162 has a cylindrical chamber 164 with a fixed cylindrical post 166 acting as the flow restrictor. The flow restrictor 166 has a conical tip 167 which extends axially into the receiving portion 152. The diameter of the cylindrical chamber is smaller than the diameter of the receiving portion such that a flat annular ledge 168 joins the receiving and foam generating portions around the base of the conical tip 167. When the draw tube 156 is fully inserted into the receiving portion 152, the end 158 of the tube 156 and the ledge 168 meet to form a plurality of elongated passages between the receiving portion 152 and the foam generating portion 162. These passages direct the pressurized gas into the liquid 16 to form the foam in the foam generating portion 162.

A fifth embodiment of the foam generating device is identical to the fourth embodiment 150 just described except that at least one annular washer 170 is positioned between the tube 156 and the ledge 168 and the end surface 158 of the tube 156 is flat.

Figure 9:
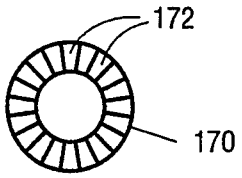
FIG. 9 is a top view of a fluted washer which may be used in an alternative to the fluted tube end in the fourth embodiment of the foaming device in accordance with the invention shown in FIG. 8.
Figure 10:
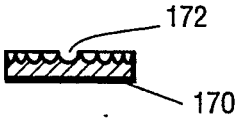
FIG. 10 is a side view of the washer shown in FIG. 9.

A top and a side view of the washer 170 are shown in FIGS. 9 and 10 respectively. One side of the washer 170 has a plurality of radial flutes 172 therein. The tube 156, washer 170, and the ledge 168 are assembled together to form the elongated passages between the receiving portion and the foam generating portion for the pressurized gas. This design is particularly advantageous where different foamable liquids are used or where different foam consistencies are desired. Different washers with differing flute sizes or stacks of and/or combinations of washers can be installed to yield different passages with different cross sectional areas in order to optimize the foam generation. Of course, radial flutes can be provided on both sides (not shown) of the washer 170, if desired.

Third Preferred Embodiment

A third preferred embodiment of the foam dispensing apparatus in accordance with the invention is shown in FIGS. 11 through 16. This preferred embodiment may utilize any of the alternative foam generating devices discussed above. The following description includes one of these alternatives. It is to be understood that other combinations can also be used.

Figure 11:
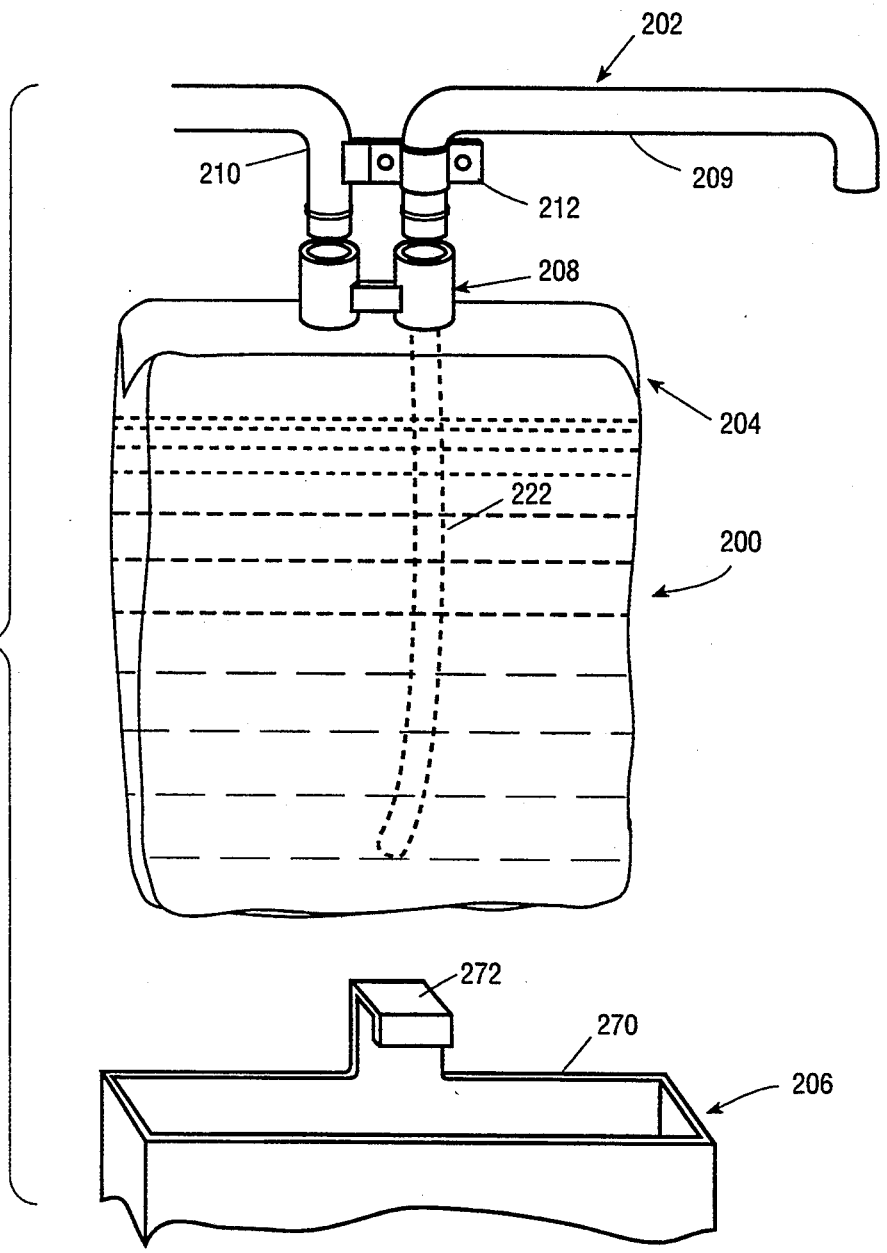
FIG. 11 is an exploded perspective view of a third embodiment of the foam dispensing apparatus in accordance with the invention having a collapsible container.
Figure 12:
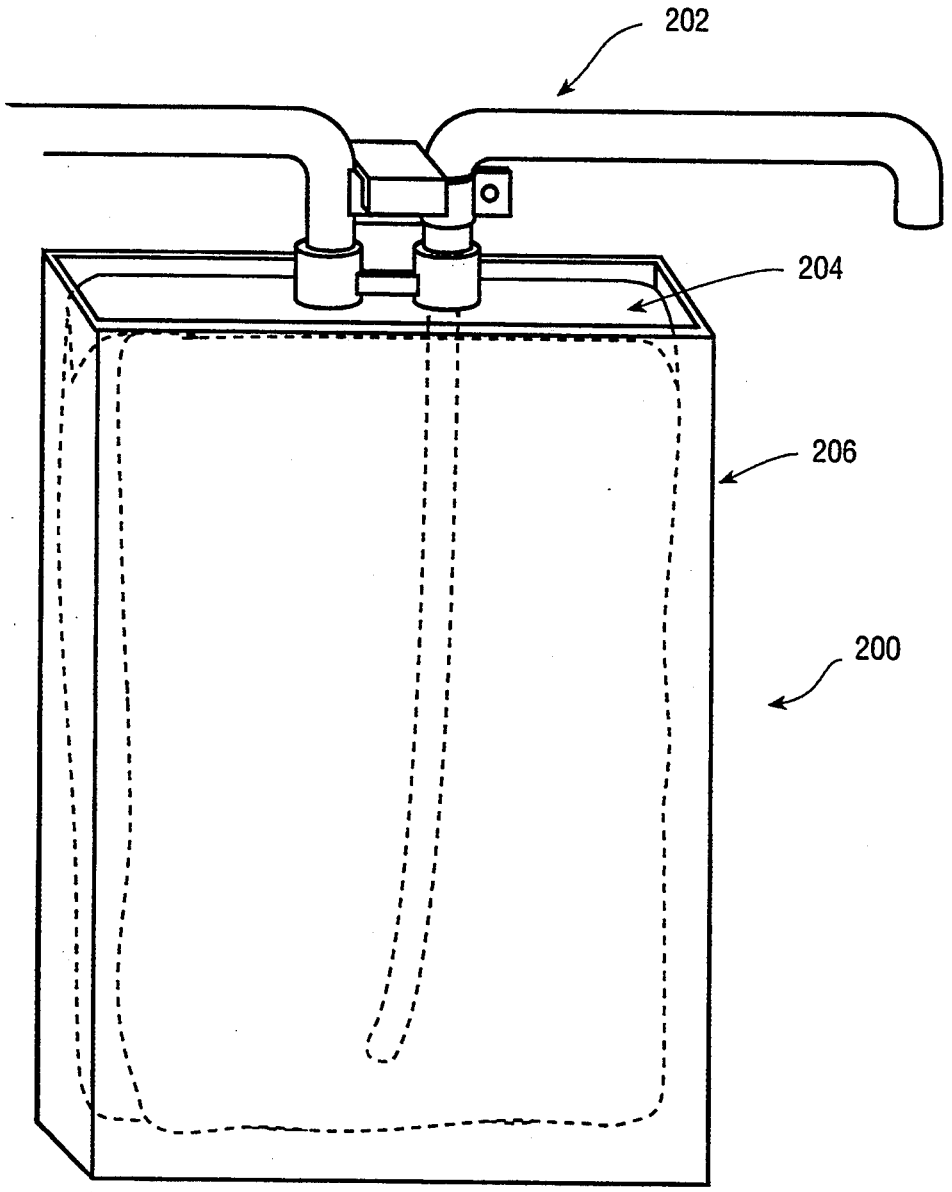
FIG. 12 is an assembled perspective view of the third embodiment of the foam dispensing apparatus in accordance with the invention.

The foam dispensing apparatus 200 in accordance with the invention is shown in exploded view in FIG. 11. The apparatus includes a foam generating device 202, a collapsible container 204 and a retaining member 206. The collapsible container 204 is coupled removably to the foam generating device 202 by an integral connector 208. The assembled foam dispensing apparatus 200 is shown in perspective in FIG. 12.

The foam generating device 202 preferably is contained in a spigot shaped body 209. The foam generating device 202, the connector 208 and the upper portion of the collapsible bag 204 are shown in elevational sectional view in FIG. 13. The foam generating device 202 has a receiving portion 214, a foam generating portion 216, and a discharge portion 218. The receiving portion 214 has an open cylindrical chamber defined by an inner wall 220 and is sized to receive the upper end of a draw tube 222 extending out of the container 204 through the connector 208. The inner wall 220 has a plurality of inwardly projecting, axially extending ribs 224 positioned circumferentially about the axis of the receiving portion 214. These ribs are sized to frictionally receive and support the tube 222 therebetween in a spaced manner from the inner wall 220. Each of the ribs 224 has a V shaped tapered end to guide the draw tube 222 into the receiving portion 214. Optionally, the outer wall 226 of the receiving portion 214 may have a circumferential channel (not shown) therein spaced from the open end of the receiving portion of the device 202 and an O ring (not shown) may be disposed in the channel to seal the connector 208 and the receiving portion together as will be more fully described below.

The foam generating portion 216 has a coaxial cylindrical foam generating chamber formed by an inner wall 228 which has a smaller diameter than the inner wall 220 of the receiving portion 214. Since the receiving portion 214 and foam generation portion 216 are coaxial, an annular flat ledge 230 joins the chambers in these two portions. The foam generating chamber 227 has a cylindrical post flow restrictor 232 attached at its base to the body of the foam generating portion 216. The flow restrictor 232 may be integrally molded into the foam generating device or may be separately mounted with glue or other attachment means. The flow restrictor 232 extends coaxially through the foam generating chamber 227 spaced from the inner wall 228. The tip 234 of the flow restrictor 232 has a conical shape and has its base located preferably in the plane of the ledge 230.

Means must be provided for connecting a pressurized gas to the container 204 which may be simply a pipe connected to the clamp 212 supporting the foam generating device 202. This support may be an integral "C" clamp arrangement or other conventional support design.

Figure 13:
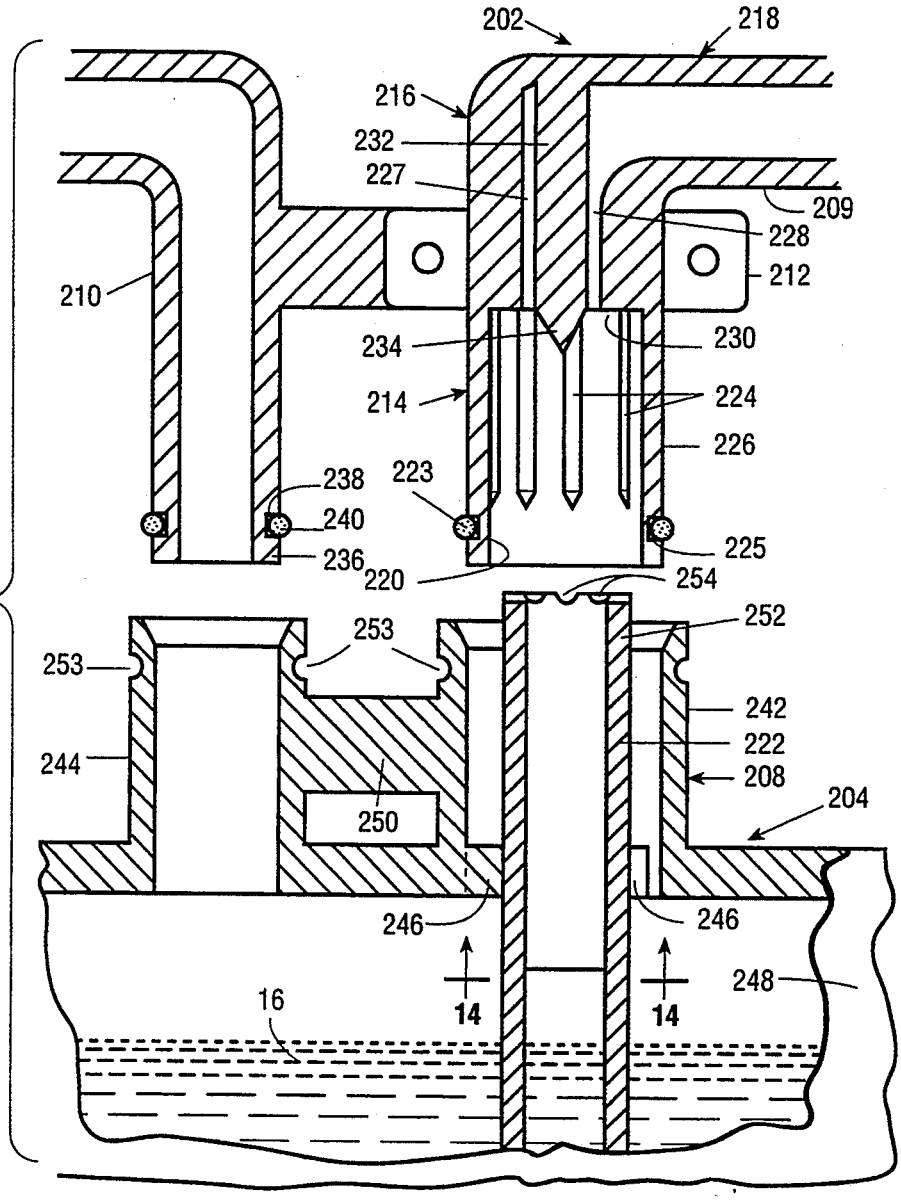
FIG. 13 is an enlarged, exploded sectional view of the foam dispensing apparatus shown in FIGS. 11 and 12 showing greater details.
Figure 14:
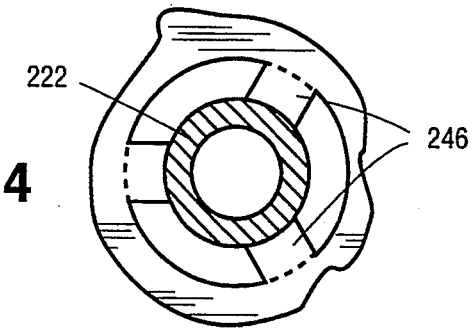
FIG. 14 is a sectional view of the apparatus taken along the line 14—14 in FIG. 13.

As shown in FIG. 13, the connector 208 is an integral part of the container 204. The connector 208 has first and second tubular sockets 242 and 244 forming passages through a flange portion 245 of the connector 208 in the collapsible container 204 which are sized to receive the receiving portion 214 of the foam generating device 202 and the open end 236 of the connecting means 210 respectively. Optionally O rings (not shown) may provide a pressure seal for the apparatus for preventing the pressurized gas from escaping to the outside of the apparatus except through the foam generating device 202.

The first socket 242 of the connector 208 has at least three integral support members 246 to laterally space the draw tube 222 coaxially in the center of the socket. These supports 246 are preferably separate from the tube 222 and are spaced 120 degrees apart around the tube 222 as is shown by the sectional view of FIG. 14. Alternatively, the support members may either be integral with the tube 222 and frictionally fit within the socket 242 or the tube 222 and connector 208 may be molded as a one piece unit to the collapsible bag portion 248 of the container 204. In this latter case, the support member 246 could be a solid piece with a plurality of bores therethrough around the tube 222.

The sockets 242 and 244 are spaced apart and connected together by an integral web 250. The web 250 may be used to hold the collapsible container 204 firmly in the container 206. The web and clamp are squeezed together to draw or pull the first and second sockets onto the receiving portion 214 and the open end 236. The tube 222 is preferably a separate piece, held in position in the socket 242 by the supports 246. Radial flutes 254 as in the fourth alternative embodiment 150 of the foam generating device described above are also provided.

Figure 16:
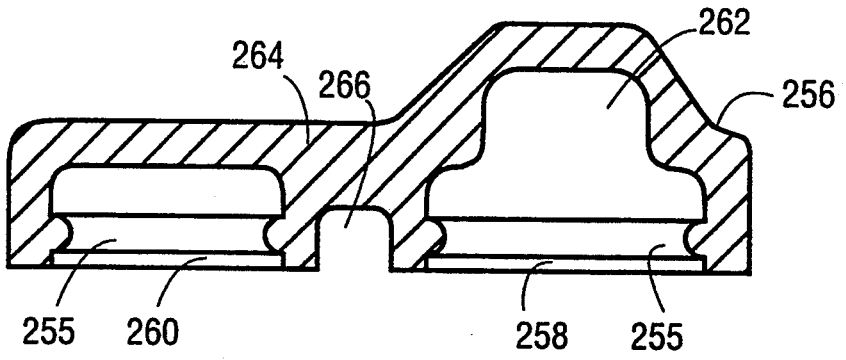
FIG. 16 is a sectional view of the cap taken along the line 16—16 in FIG. 15.
Figure 15:
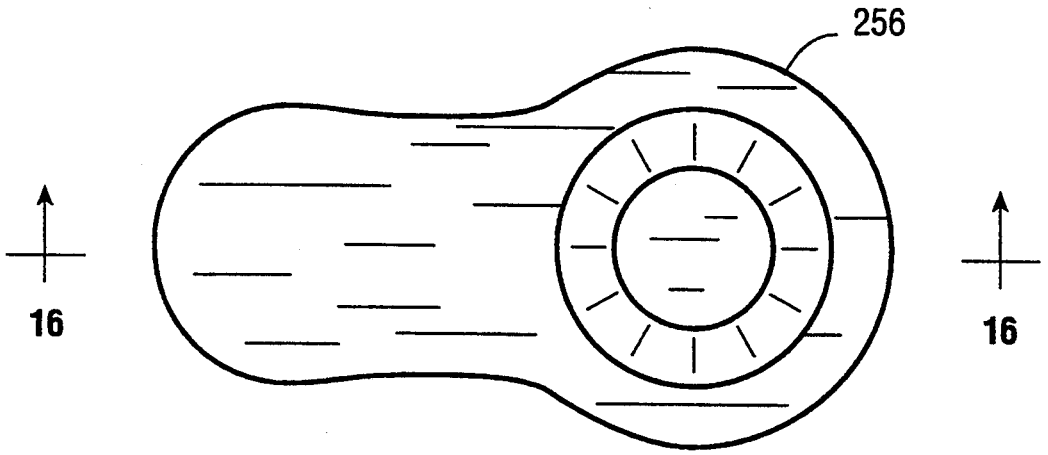
FIG. 15 is a is a top view of a cap for the connector on the collapsible bag in accordance with the third embodiment of the present invention.

The outside walls of the sockets 242 and 244 contain circumferential grooves 253 designed to mate with corresponding inwardly projecting annular bumps or ribs 255 in the cavities of a cover 256. The cover 256 is placed on full or empty collapsible containers prior to use. A top view of the cover is shown in FIG. 15 and a sectional view is shown in FIG. 16. The cover 256 is preferably a one piece molded plastic body having two spaced open cavities 258 and 260 sized to fit over the first and second sockets respectively. The cavity 258 has a recessed portion 262 which receives the upper end of the tube 222. This recessed portion generates a dome shape over this cavity. If the tube 222 is separately supplied, this recessed portion 262 may be omitted from the cover. The cavities are joined by a connecting portion 264 which forms a channel 266 between the cavities to permit elastic flexing and expansion of the walls of the cover to snap fit the bumps 255 into the grooves 253 of the sockets 242 and 244.

The retainer 206 is a generally rigid, preferably plastic sleeve 270, which has a hook shaped hanger portion 272 extending upward from the top wall of the sleeve 270. The retainer 206 may be a solid plastic body or it may be a mesh construction or other so long as it can restrict expansion of the collapsible container to prevent breach of the container. In the embodiment shown in the Figures, the retainer is an open box shaped sleeve. It could also be a closed bottomed box or it could be cylindrical in shape.

The assembly of the foam dispensing apparatus is completed by installing a full container 204 to the foam generating device 202 and then slipping a retainer 206 over the container 204 and hooking the hanger 272 over the web 250. When the foam generating device 202 and the collapsible container 204 are joined together, the user can open a valved supply line so that pressurized gas can enter the container 204. The pressurized gas pushes against the surface of the foamable liquid 16 in the container 204 and causes the liquid in the tube 222 to rise up into the receiving portion 214 of the foam generating device 202. Simultaneously, a portion of the gas passes out of the container and into the receiving portion 214 through the annular passage around the tube 222. This portion of the gas then passes into the foam generating portion 216 through the elongated passages formed between the flutes 254 in the ledge 230. The gas flow into the foam generating chamber 227 simultaneously with the liquid flow into the foam generating chamber produces the foam. The foam then passes through the discharge portion 218 and out the spigot 209. Note that the spigot shaped body 209 can be rotates so as to point in any desired direction in a horizontal plane. Thus the apparatus 200 may be installed flush against a wall and the spigot 209 rotated out toward the user only when needed. Although the mounting arrangement for the apparatus against a wall or other structure is not shown, any conventional mounting arrangement may be utilized.

Fourth Preferred Embodiment

Figure 17:
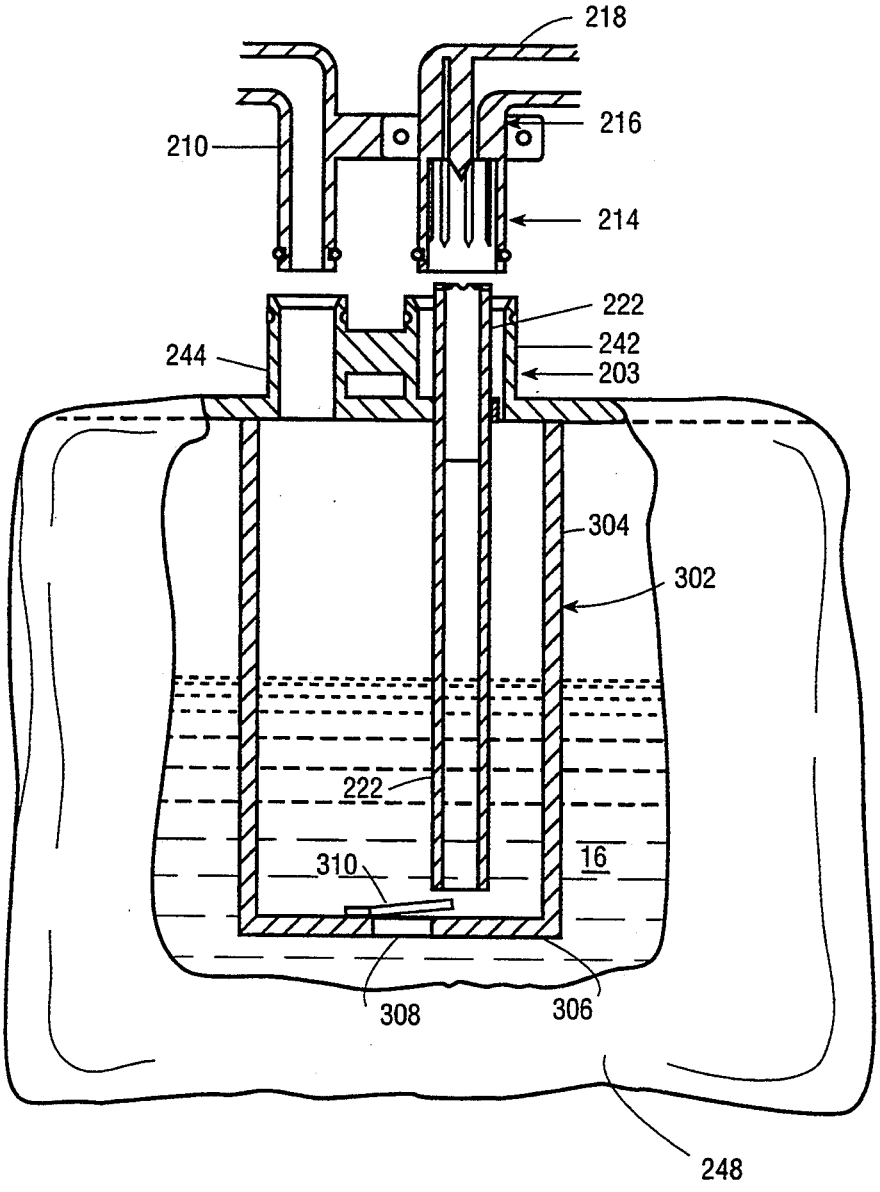
FIG. 17 is a side elevational view with portions in section, of a fourth embodiment of the foam dispensing apparatus in accordance with the present invention.

A fourth preferred embodiment of the present invention is shown in FIG. 17. This embodiment 300 is almost identical to the third just described except that a pressurization chamber 302 is formed integrally with the connector 208. Therefore like numbers will be utilized where appropriate and the discussion will be centered on the different features of this embodiment.

The pressurization chamber is a closed tubular body around the draw tube 222 attached to the connector 208 such that both sockets 242 and 244 communicate with the interior of the chamber 302. The chamber 302 preferably is made of a plastic material and has a tubular side wall 304 and a bottom wall 306. The bottom wall 306 has a centrally disposed aperture 308 therethrough which is covered on the inside of the chamber 302, by a hinged flapper 310 such that the flapper permits fluid entry into the chamber and prevents passage of the fluid in the opposite direction. When the pressurized gas enters the chamber 302, the flapper 310 shuts, preventing pressurization of the collapsible container bag 248. Thus there is no need for the retaining member 206. This embodiment operates as above described with reference to the second preferred embodiment 50 shown in FIG. 2. Operation will thus not be repeated here. The pressurization chamber 302 may be integral with the connector 208 or may be glued or threadably joined thereto. The shape of the chamber 302 may also differ. Also, the connector 208 may be a separate component from the bag 248 itself.

While only certain preferred embodiments of this invention have been described, it is understood that many embodiments thereof are possible without departing from the principles of this invention as defined in the claims which follow. All patents, patent applications, and publications referred to herein are hereby incorporated by reference in their entirety.

What is claimed is:

1. A foam dispensing apparatus comprising:

a container for holding a foamable liquid;

means for directing a pressurized gas into said container;

a foaming device having a hollow receiver portion, a foam generating portion having an inner wall, and a discharge portion;

a flow restrictor in said foam generating portion spaced from said inner wall; and a tube having one end in said receiver portion, said tube extending out of said foaming device into said container for directing foamable liquid through said receiver portion into said foam generating portion;

said one end of said tube and said receiver portion defining a plurality of spaced, passages juxtaposed said tube connecting said receiver portion with said foam generating portion, whereby pressurized gas entering said container forces said foamable liquid through said tube and into said foam generating portion past said flow restrictor while said gas simultaneously enters said foam generating portion through said passages so as to create foam from said foamable liquid.

2. The apparatus according to claim 1 wherein said receiver portion has an inner wall spaced from said tube to permit said gas to pass between said tube and said inner wall of said receiver portion.

3. The apparatus according to claim 2 wherein said inner wall of said receiver portion includes a plurality of axial ribs engageable with said tube to laterally support and position said tube in said receiver portion.

4. The apparatus according to claim 1 wherein said receiver portion has an inner wall sized to operably engage said tube and, said inner wall of said receiver portion having a plurality of axial flutes or grooves therein extending into said foam generating portion and forming said passages into said foam generating portion.

5. The apparatus according to claim 4 wherein said receiver portion further includes a plurality of axial ribs spacing a portion of said tube from said inner wall of said receiver portion.

6. The apparatus according to claim 1 wherein said foam generating portion has a hollow cavity coaxially aligned with said receiver portion, said receiver portion merging with said foam generating portion at an annular ledge.

7. The apparatus according to claim 6 wherein said one end of said tube abuts against said annular ledge.

8. The apparatus according to claim 6 wherein disposed between said ledge and said tube is a plurality of radially extending grooves forming said passages between said tube and said receiver portion.

9. The apparatus according to claim 8 wherein said plurality of radial grooves in said ledge forms said passages between said tube and said receiver portion.

10. A foam dispensing apparatus comprising:

a container for holding a foamable liquid;

means for directing a pressurized gas into said container;

a foaming device having a hollow receiver portion, a foam generating portion having an inner wall, and a discharge portion;

a flow restrictor in said foam generating portion spaced from said inner wall;

a tube having one end in said receiver portion, said tube extending out of said foaming device into said container for directing foamable liquid through said receiver portion into said foam generating portion;

a plurality of spaced passages juxtaposed said tube connecting said receiver portion with said foam generating portion, whereby pressurized gas entering said container forces said foamable liquid through said tube and into said foam generating portion past said flow restrictor while said gas simultaneously enters said foam generating portion through said passages so as to create foam from said foamable liquid; and an annular, generally flat washer having top and bottom sides disposed between said tube and said flow restrictor, and said washer having a plurality of radial grooves forming said passages in at least one of said top and bottom sides.

11. The apparatus according to claim 1 wherein said flow restrictor centrally disposed in said foam generating portion is a generally cylindrical fixed post axially extending through the foam generating portion, said post having a generally conical end partially protruding coaxially into said one end of said tube.

12. The apparatus according to claim 1 wherein said container is a collapsible bag having a connector assembly at a top side thereof, said assembly adapted to mate with said receiver portion of said foaming device.

13. A foam dispensing apparatus comprising:

a collapsible container for holding a foamable liquid, said container having a connector integrally mounted thereto;

means for directing a pressurized gas into said container;

a foaming device having a hollow receiver portion, a foam generating portion having an inner wall, and a discharge portion;

a flow restrictor in said foam generating portion spaced from said inner wall;

said receiver portion adapted to receive an end portion of a tube extending out of said container through said connector when said connector is mated with said receiver portion of said foaming device for directing said foamable liquid through said receiver portion into said foam generating portion;

said one end portion of said tube and said receiver portion, when mated, defining a plurality of spaced passages juxtaposed said tube connecting said receiver portion with said foam generating portion whereby pressurized gas entering said container forces said foamable liquid through said tube and into said foam generating portion past said flow restrictor while said gas simultaneously enters said foam generating portion through said passages so as to create foam from said foamable liquid.

14. The apparatus according to claim 13 wherein said tube is removable from said container.

15. The apparatus according to claim 14 including said connector comprising a tubular socket portion adapted to sealingly receive and engage said receiver portion of said foaming device.

16. The apparatus according to claim 15 wherein said socket portion has a support member therein for supporting and spacing said tube from an inner wall of said tubular socket.

17. The apparatus according to claim 16 wherein said support member slidably supports said tube and permits passage of pressurized gas from said container through said socket and around said tube.

18. The apparatus according to claim 15 wherein said connector further includes a connecting inlet for directing said pressurized gas into said container.

19. The apparatus according to claim 13 further comprising a support housing adapted to fit over said collapsible container to withstand pressure applied to said foamable liquid through said connector.

20. A foam dispensing apparatus comprising:

a collapsible container for holding a foamable liquid, said container having a connector integrally mounted thereto having first and second sockets;

a support housing adapted to fit over said container;

a foaming device having a hollow receiver portion, a foam generating portion having an inner wall, and a discharge portion;

a flow restrictor body in said foam generating portion spaced from said inner wall;

means for directing a pressurized gas into said container through said second socket of said connector;

said receiver portion adapted to receive an end portion of a tube extending out of said container through said connector when said connector is mated with said receiver portion of said foaming device for directing said foamable liquid through said receiver portion into said foam generating portion;

said one end portion of said tube and said receiver portion, when mated, defining a plurality of spaced passages juxtaposed said tube connecting said receiver portion with said foam generating portion, whereby pressurized gas entering said container forces said foamable liquid through said tube and into said foam generating portion past said flow restrictor while said gas simultaneously enters said foam generating portion through said passages so as to create foam from said foamable liquid.

21. The foam dispensing apparatus according to claim 20 wherein said flow restrictor is removable.

22. The foam dispensing apparatus according to claim 20 further comprising a pressurization chamber in said container surrounding said first socket, said chamber having a restricted aperture therethrough.

23. The foam dispensing apparatus according to claim 22 wherein said restricted aperture is restricted to flow only into the chamber through said aperture.

24. The foam dispensing apparatus according to claim 22 wherein said restricted aperture is a check valve permitting only flow into said chamber.

25. A foam dispensing apparatus comprising:

container for holding a foamable liquid;

means for directing a pressurized gas into said container;

a foaming device attached to said container, said device having a hollow receiver portion, a foam generating portion having an inner wall, and a discharge portion;

a flow restrictor in said generating portion spaced from said inner wall; and a tube having one end in said receiver portion, said tube extending out of said foaming device into said container for directing foamable liquid through said receiver portion into said foam generating portion;

a pressurization chamber in said container enclosing a portion of said tube, said pressurization chamber including means for permitting foamable liquid flow only into said pressurization chamber from said container;

said one end of said tube and said receiver portion defining a plurality of spaced passages juxtaposed said tube connecting said receiver portion with said foam generating portion, whereby pressurized gas entering said container forces said foamable liquid through said tube and into said foam generating portion past said flow restrictor while said gas simultaneously enters said foam generating portion through said passages so as to create foam from said foamable liquid.

26. The apparatus according to claim 25 wherein said receiver portion has an inner wall sized to operably engage said tube, and said inner wall of said receiver portion having a plurality of axial flutes or grooves therein extending into said foam generating portion and forming said passages into said foam generating portion.

27. The apparatus according to claim 26 wherein said receiver portion further includes a plurality of axial ribs spacing a portion of said tube from said inner wall of said receiver portion.

28. The apparatus according to claim 25 wherein said foam generating portion has a hollow cavity coaxially aligned with said receiver portion and said receiver portion merging with said foam generating portion at an annular ledge.

29. The apparatus according to claim 28 wherein said one end of said tube abuts against said annular ledge.

30. The apparatus according to claim 29 wherein said ledge has a plurality of radially extending grooves therein forming said passages between said tube and said receiver portion into said foam generating portion.

31. A foam dispensing apparatus comprising:

a container for holding a foamable liquid;

means for directing a pressurized gas into said container;

a foaming device attached to said container, said device having a hollow receiver portion, a foam generating portion having an inner wall, and a discharge portion;

a flow restrictor in said foam generating portion spaced from said inner wall; and a tube having one end in said receiver portion, said tube extending out of said foaming device into said container for directing foamable liquid through said receiver portion into said foam generating portion;

a pressurization chamber in said container enclosing a portion of said tube, said pressurization chamber including means for permitting foamable liquid flow only into said pressurization chamber from said container;

a plurality of spaced passages juxtaposed said tube connecting said receiver portion with said foam generating portion, whereby pressurized gas entering said container forces said foamable liquid through said tube and into said foam generating portion past said flow restrictor while said gas simultaneously enters said foam generating portion through said passages so as to create foam from said foamable liquid; and an annular, generally flat washer having top and bottom sides disposed between said tube and said flow restrictor, and said washer having a plurality of radial grooves forming said passages in at least one of said top and bottom sides.

* * * * *